United States Patent [19]

Conway

[11] 4,241,683

[45] Dec. 30, 1980

[54] LIQUID CARGO TANK CONSTRUCTION

[76] Inventor: Charles S. Conway, Featherbed La., New Vernon, N.J. 07976

[21] Appl. No.: 913,956

[22] Filed: Jun. 9, 1978

Related U.S. Application Data

[63] Continuation-in-part of Ser. No. 809,395, Jun. 23, 1977, abandoned.

[51] Int. Cl.[3] ..... B63B 25/08

[52] U.S. Cl. ..... 114/74 R; 114/256; 220/22

[58] Field of Search ..... 114/65 R, 73, 74 R, 114/74 T, 74 A, 76, 78, 125, 256, 257; 220/9 LG, 22, 15

[56] References Cited

U.S. PATENT DOCUMENTS

| | | | |
|---|---|---|---|
| 2,696,185 | 12/1954 | Snoddy | 114/74 R |
| 3,640,237 | 2/1972 | Phelps | 114/74 A |
| 3,680,729 | 8/1972 | Bonavent | 220/22 |
| 3,745,960 | 7/1973 | Devine | 114/74 R |
| 3,906,880 | 9/1975 | Hebert | 114/74 R |

FOREIGN PATENT DOCUMENTS

| | | | |
|---|---|---|---|
| 2118091 | 11/1971 | Fed. Rep. of Germany | 114/74 R |

*Primary Examiner*—Edward R. Kazenske
*Assistant Examiner*—D. W. Keen
*Attorney, Agent, or Firm*—Kenyon & Kenyon

[57] ABSTRACT

A tank vessel for the transportation of liquid cargo having a specific gravity which is less than that of water. The vessel includes a hull comprising a bottom and sides, a top deck, and at least one transverse bulkhead disposed within the hull forming a plurality of watertight cargo compartments between the top deck and the hull bottom. The improvement of the invention comprises a watertight horizontal bulkhead disposed within the hull between the top deck and the hull bottom above the waterline of the tank vessel and at a distance above the hull bottom which is less than or equal to $H(S_w/S_c)$, where H represents the vertical height of the waterline of the vessel above the hull bottom, $S_w$ represents the specific gravity of water, and $S_c$ represents the specific gravity of the liquid cargo. The bulkhead forms separate upper and lower watertight liquid-receiving tanks within the compartment above and below the waterline of the vessel and the upper tanks have a vertical height which is less than that of the lower tanks.

10 Claims, 5 Drawing Figures

10
11
12
13
14
15
16
17
18
19
20
21
22
23
24
25
26
2
2
h
H

LIQUID CARGO TANK CONSTRUCTION

BACKGROUND OF THE INVENTION

This application is a continuation-in-part of my earlier filed application, Ser. No. 809,395 filed June 23, 1977 now abandoned.

FIELD OF THE INVENTION

The present invention relates generally to tanks in a fluid, and in particular to an improved liquid cargo tank construction for tanker vessels.

DESCRIPTION OF THE PRIOR ART

Tanker vessels for the transportation in bulk of liquid cargo are known in the art. See, for example, U.S. Pat. No. 2,918,032. Such tanker vessels generally comprise a plurality of liquid-tight transverse bulkheads and one or more liquid-tight longitudinal bulkheads which subdivide the tanker vessel into a plurality of liquid-tight storage compartments. If the bottom or a side of the hull of such a tanker vessel is ruptured by grounding or some other accident, the affected cargo tanks will leak until the "pressure head" of the liquid cargo in each tank, i.e., approximately the portion of the liquid cargo disposed above the waterline of the vessel, flows out of the tanker vessel. Such leakage is a significant potential problem in so-called "SWBT" and "double-bottom" tanker vessels which have greater freeboard than conventional tanker vessels, and, hence, a greater cargo pressure head.

In recent years, pollution by oil tankers as a result of a hull rupture caused by grounding or other major catastrophe has become of increasing concern. As a result, various anti-pollution tanker constructions have been proposed. One of these is the so-called "double-bottom" tanker design which essentially comprises a tanker vessel having two spaced-apart hull bottoms. The purpose of this design is to prevent leakage from the tanker's cargo tanks if the outer hull bottom is ruptured by, for example, grounding. Such a design may not prevent leakage, however, where major damage is caused by grounding or some other accident since such damage may also cause the inner hull bottom to rupture in addition to the outer one. Moreover, besides the additional expenses involved in manufacturing such a tanker, the space between the inner and outer hull bottoms is unusable for the transportation and storage of cargo and, as a result, such a design increases the expenses of operating and maintaining the tanker. Bottom damage repair costs are also significantly greater in such tanker vessels, and such double-bottom tanker vessels require a rigid internal structure to support the huge loading stress of the cargo on the inner hull bottom and water on the outer hull bottom which tends to rupture both the inner and outer hull bottoms when hull damage occurs.

It has also been proposed to construct a tanker vessel with double sides defining side tanks extending from the top deck of the vessel to the hull bottom which are disposed adjacent to and associated with cargo tanks in the vessel. See U.S. Pat. No. 3,832,966. These side tanks have a volume from the hull bottom to the waterline of the tanker vessel which is equal to the respective volumes of the cargo tanks above the waterline. Valves coupling the side tanks to the cargo tanks are opened if the tanker hull is ruptured to permit oil in the cargo tanks to drain off into the side tanks so that the oil above the waterline in the cargo tanks does not escape from the ruptured hull bottom. Larger vents are used in the side tanks than in the cargo tanks to achieve this drainage from the cargo tanks to the side tanks instead of into the sea. The disadvantage of this design, however, is that the side tanks provided for receiving the "pressure head" of the liquid cargo carried in the cargo tanks is, similar to the space between the inner and outer hull bottoms in a double-bottom tanker, unavailable for the storage and transportation of cargo and, accordingly, increases the fabrication, maintenance and operating costs of the tanker vessel. Moreover, such a design is theoretical only and in practice would save no more than 2 or 3% of the liquid cargo carried by such a tanker vessel.

SUMMARY OF THE INVENTION

It is, therefore, an object of the present invention to provide an improved liquid cargo tank construction for tanker vessels which overcomes the aforementioned disadvantages of heretofore known cargo tank constructions and reduces fluid cargo losses and pollution in case of rupture of the tanker hull.

It is also an object of the present invention to provide an improved liquid cargo tank construction for tanker vessels which reduces cargo losses at sea and in port from bottom or side hull damage, corrosion, fracture leakage, and tanker operational or personnel error.

It is another object of the present invention to provide an improved liquid cargo tank construction for tanker vessels which reduces stability problems occurring as a result of major hull bottom damage to the tanker vessel.

It is still a further object of the present invention to provide an improved liquid cargo tank construction for tanker vessels which serves as an inherently safe tanker vessel anti-pollution system and is simultaneously fully usable for the transportation and storage of liquid cargo.

These and other objects of the present invention are achieved in a vessel disposed in water for receiving liquids having a specific gravity which is less than water including a bottom, sides and a top forming at least one watertight compartment between the top and bottom of the vessel for receiving the liquid. The improvement comprises a watertight horizontal bulkhead disposed within the vessel between the top and bottom above the waterline of the vessel and at a distance above the bottom which is less than or equal to $H(S_w/S_c)$, where H represents the vertical height of the waterline of the vessel above the bottom, $S_w$ represents the specific gravity of water, and $S_c$ represents the specific gravity of the liquid cargo. The bulkhead forms separate upper and lower watertight liquid-receiving tanks within the compartment above and below the waterline of the vessel and the upper tanks have a vertical height which is less than that of the lower tanks.

The vessel may comprise a tank vessel for the transportation of liquid cargo having a specific gravity which is less than that of water including a hull comprising a bottom and sides, a top deck, and at least one transverse bulkhead disposed within the hull forming a plurality of watertight cargo compartments between the top deck and the hull bottom. The improvement comprises a watertight horizontal bulkhead disposed within the hull between the top deck and the hull bottom above the waterline of the vessel and at a distance above the hull bottom which is less than or equal to $H(S_w/Sc)$, where H represents the vertical height of the waterline of the vessel above the hull bottom, $S_w$ represents the specific gravity of water, and $S_c$ represents the specific gravity of the liquid cargo. The horizontal bulkhead forms separate upper and lower watertight cargo tanks within at least one of the cargo compartments above and below the waterline of the vessel, and the upper tanks have a vertical height which is less than that of the lower tanks.

The horizontal bulkhead of the invention isolates and contains the pressure head of the liquid cargo in the cargo compartment, thus greatly reducing the leakage of the cargo carried by the vessel. Thus, in contrast to conventional tankers, including double-bottom tankers (when the inner hull bottom of such a tanker is ruptured), which will leak rapidly upon rupture of the bottom or sides of the hull until the pressure head of the cargo has been lost or is removed, a vessel constructed according to the invention will leak a lesser amount of liquid cargo, if any, upon the occurrence of a bottom hull rupture due to the lighter specific gravity of the liquid cargo carried by the vessel compared to water and should virtually eliminate major hull bottom leakage. Leakage through ruptures in the sides of the hull of the vessel will also be considerably reduced. Thus, massive marine pollution incidents caused by grounding and major accidents should be reduced to minor pollution incidents.

The location of the horizontal bulkhead of the invention also minimizes the danger of damage to the bulkhead, and the loss of its effectiveness to prevent leakage of cargo from the vessel, in the event of a hull rupture since the bulkhead is located at its highest possible vertical height in the hull of the vessel that can be used to prevent leakage of cargo, furthest from those hull areas which are likely to be ruptured, namely, the hull sides and bottom. Moreover, locating the bulkhead in the vessel at a vertical height which is the maximum usable also significantly reduces the expense of either constructing such a vessel or adding such a bulkhead to an existing vessel since the height of the upper cargo tanks in the vessel is minimized and the weight of the cargo in the upper tanks is accordingly reduced. Less support structure for the bulkhead is therefore required to support the cargo in the upper tanks.

Thus, the invention not only will effectively reduce or eliminate hull leakage from a damaged tanker vessel, it further will minimize the danger that the bulkhead will be rendered ineffective in the event of a collision or grounding and will reduce the cost of constructing new vessels or fitting existing vessels with such a bulkhead.

The improved tank vessel of the invention may include valve means disposed between and coupling the upper and lower cargo tanks for permitting transfer of the liquid cargo from the upper tank to the lower tank and from the lower tank to the upper tank. In a preferred embodiment of the invention, the tank vessel includes a plurality of longitudinal and transverse bulkheads disposed within the vessel hull and the horizontal bulkhead forms separate upper and lower watertight cargo tanks in a plurality of the cargo compartments, and/or bunker tanks. The tank vessel further includes main liquid cargo charging and discharging means coupled by valving to the upper and lower cargo tanks for charging and discharging the upper and lower tanks, and additional liquid cargo charging and discharging means for charging and discharging the upper tanks. The additional charging and discharging means may include suction means for removing the liquid cargo from the upper cargo tanks, for example, motor-driven pump means, first pipe means coupled to the suction means, and second pipe means coupled to the first pipe means and the upper cargo tanks. The first and second pipe means interconnect the upper cargo tanks and permit salvage of the liquid cargo in the upper tanks, charging and discharging of multi-grade cargoes, and transfer of the liquid cargo from one of the upper cargo tanks to another of the tanks in the vessel. Each of the upper cargo tanks may also include sump means for collecting liquid cargo in the upper cargo tanks. In this embodiment of the invention, the valve means in each of the upper cargo tanks is disposed in the sump means.

The advantages of the foregoing embodiments of the invention are that the upper cargo tanks can be fully utilized for cargo and/or ballast. This feature permits the tank vessel to be smaller in size, and thus less expensive to operate, compared to "double-bottom" or "SWBT" tankers. The upper cargo tanks can also be loaded as one tank and the liquid cargo can be discharged through the valve means by gravity to the lower cargo tanks by opening the valve means. Alternatively, any or all of the upper cargo tanks can be utilized for the transportation and storage of multi-grade cargoes since the additional charging and discharging means interconnects the upper cargo tanks. Moreover, since the cargo carried by the vessel has a specific gravity which is less than that of water, the liquid cargo in the lower cargo tanks will have a positive upward pressure when the bulkhead is disposed below the neutral pressure height. Thus, by opening a valve to an upper cargo tank, the liquid cargo is transferred from the lower cargo tank to the upper cargo tank where it can be readily discharged or transferred using either the charging and discharging means or the addiional charging and discharging means of the tank vessel. Thus, a tank vessel constructed according to the invention should not require salvage cargo removal assistance, which is a very expensive and time-consuming operation.

Aside from the foregoing, there are numerous other advantages provided by a tank vessel constructed in accordance with the invention. For example, bottom damage repair costs following grounding are greatly reduced compared to vessels with double bottoms. Also, the safety of the vessel is considerably enhanced compared to other types of ships following major accident or grounding damage in cargo tank areas since the vessel will practically maintain its normal trim and draft when all of the lower cargo tanks are full no matter which cargo tanks are ruptured. As a result, a tank vessel constructed according to the invention is virtually unsinkable, regardless the extent of the damage to the hull bottom, as long as longitudinal structural integrity of the vessel still exists. A tank vessel constructed according to the invention will also have little or no change in buoyancy after grounding unlike double-bottom tanker vessels which, upon grounding, will lose buoyancy rapidly. Finally, butterworth cleaning and gasfreeing of the upper and lower cargo tanks can be carried out simultaneously from the main deck of the vessel much more rapidly than in double-bottom tanker vessels. Typically, one set of upper and lower cargo tanks in a tank vessel constructed according to the invention will require about three to five hours for butterworth cleaning and gasfreeing, whereas the same amount of cleaning would require one day or more for one set of tanks in a double-bottom tanker vessel.

It should be noted that a tank vessel according to the invention may have various configurations and may comprise, for example, an oil tanker, a barge, or an oil storage tank disposed in water in offshore drilling areas. If the vessel is a tanker, it should be noted that certain of the upper cargo tanks may also be used as dry cargo, or storage holds, in which case hatch coamings and covers, or access trunks would be installed.

These and other novel features and advantages of the invention will be described in greater detail in the following detailed description.

DETAILED DESCRIPTION

Figures 1, 2, 3:
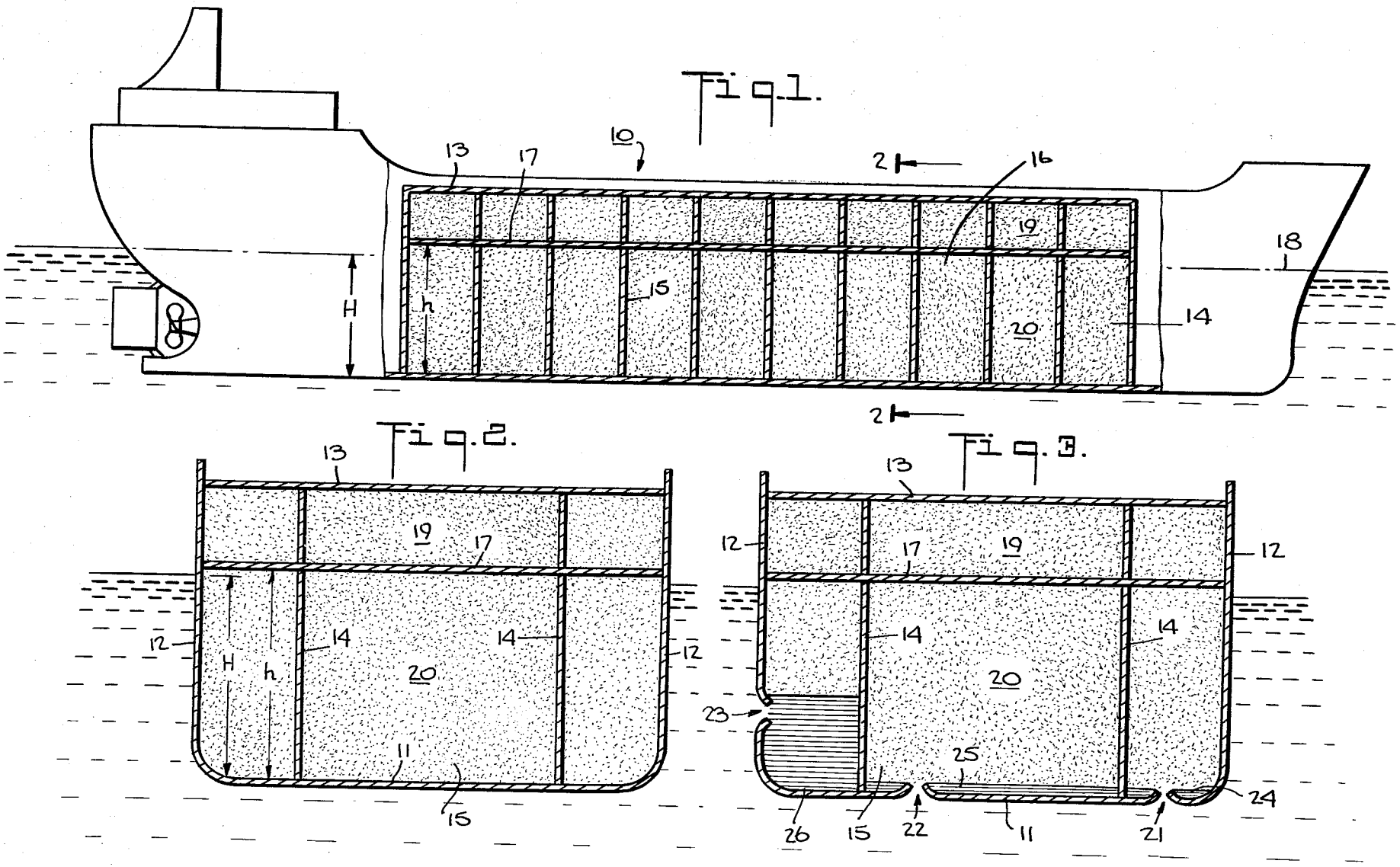
FIG. 1 is a partial, longitudinal, cross-sectional profile view of one embodiment of an improved liquid cargo tank construction for a tanker vessel constructed according to the present invention.
FIG. 2 is a transverse cross-sectional view of the liquid cargo tank construction taken along section 2—2 of FIG. 1.
FIG. 3 is another transverse cross-sectional view of the liquid cargo tank construction illustrating side and bottom hull ruptures caused by grounding and/or hull side damage.

Referring now to the drawings, in particular to FIGS. 1 and 2, there is shown a tanker vessel, generally identified by reference numeral 10, which includes a hull comprising a bottom 11 and sides 12. The vessel includes a top deck 13 and a plurality of longitudinal and transverse bulkheads 14 and 15 respectively which are disposed within the hull of the vessel and form a plurality of watertight cargo compartments 16 between top deck 13 and hull bottom 11 of the vessel. Watertight horizontal bulkhead 17 is disposed within the hull between top deck 13 and hull bottom 11 above the waterline 18 of the vessel and forms separate upper watertight cargo tanks 19 and lower watertight cargo tanks 20 within at least one of the cargo compartments, and in the illustrated embodiment of the invention in a plurality of the cargo compartments 16, above and below waterline 18 of vessel 10, so that the upper tanks have a vertical height which is less than that of the lower tanks. It should be noted that the horizontal bulkhead may form one upper cargo tank or a plurality of upper cargo tanks in the forward, aft, center or side sections of the tanker vessel, as desired, and that the vessel may include only a transverse bulkhead or may have one or more longitudinal bulkheads and transverse bulkheads forming the cargo compartments.

The horizontal bulkhead 17 is located above the waterline of the vessel, as previously stated, and also at a vertical distance h above the hull bottom of the vessel which is less than or equal to the neutral pressure height in the cargo compartments, which is also located above the vessel waterline. The latter height is the maximum vertical height at which the cargo carried by the vessel will be supported by the water in which the vessel is disposed and is given by the equation $H(S_w/S_c)$, where H represents the vertical height of the waterline of the vessel above the hull bottom, i.e., the vessel draught, $S_w$ represents the specific gravity of water, and $S_c$ represents the specific gravity of the cargo caried by the vessel. With respect to the waterline of the vessel, the bulkhead is located at a vertical distance above the waterline which is less than or equal to $H(S_w/S_c-1)$. The bulkhead is preferably located below, specifically approximately one foot below the neutral pressure height to allow for variations in the specific gravities of the cargo and the water due to changes in temperature, and vessel trim, which could cause a positive, i.e., downward, pressure to exist in the lower cargo tanks and thereby permit cargo to leak from the vessel in the event of a hull rupture when the bulkhead is located at the neutral pressure location in the cargo compartments. Thus, the preferred bulkhead height h above the hull bottom of the vessel is given by the equation $h=H(S_w/S_c)-1$, where H represents the vertical height in feet of the waterline of the vessel above the vessel hull bottom, and h represents the vertical height in feet of the bulkhead above the hull bottom.

It should be noted that the term waterline as used herein refers to the load line of the vessel which is required to be used during its operation, for example, the vessel's summer draught, and that as known to those persons skilled in the art, the location of the waterline may vary slightly with respect to its height above the vessel's hull bottom according to the load line utilized.

For example, assuming that the vessel waterline used for determining maximum loading of the vessel is located 45 ft. above the hull bottom of the vessel and that the specific gravity of the water in which the vessel is disposed is 1.0269 (which is the specific gravity of sea water), the horizontal bulkhead is preferably located at a vertical height of 45.2753 ft. above the hull bottom (or 0.2753 ft. above the waterline) when Boscan heavy crude oil (specific gravity 0.9986) is carried by the vessel, 46.8419 ft. above the vessel hull bottom (1.8419 ft. above the waterline) when heavy fuel oil (specific gravity 0.9659) is carried by the vessel, and 51.7396 ft. above the hull bottom (6.7396 ft. above the waterline) when diesel fuel (specific gravity 0.8762) is carried by the vessel.

FIG. 3 illustrates the operation of the liquid cargo tanks of the invention upon the occurrence of (a) minor grounding damage to hull bottom 11, illustrated by rupture 21 in hull bottom 11, (b) heavy grounding damage to the hull bottom, illustrated by rupture 22, and (c) side hull rupture 23 resulting from docking, barge, tug or similar damage. In the case of rupture 21, a negligible amount of cargo, illustrated by the shaded area 24, is lost since the horizontal bulkhead 17 isolates and contains the fluid pressure head of the liquid cargo in upper cargo tank 19 above lower cargo tank 20 affected by the rupture. Since the liquid cargo in the cargo compartment has a specific gravity which is less than that of water, outflow of the pressure head of the liquid cargo in the affected cargo compartment is prevented. In the case of rupture 22, again only the liquid cargo illustrated by shaded area 25 in FIG. 3 is lost due to the lesser specific gravity of the liquid cargo compared to that of the water. In the case of side hull rupture 23, a larger amount of liquid cargo, illustrated by shaded area 26, is lost, namely, that portion of the cargo which extends up to the height of the rupture in the hull. However, due to the containment of the pressure head by horizontal bulkhead 17 in the affected cargo compartment by the upper cargo tank 19, leakage of the liquid cargo from the lower cargo tank is relatively slow. This may permit some of the liquid cargo to be transferred from the affected lower cargo tank to another cargo tank of the vessel. Such a cargo transfer is achieved as a result of the negative pressure created in lower cargo tanks 20 by the location of the horizontal bulkhead.

Figure 4:
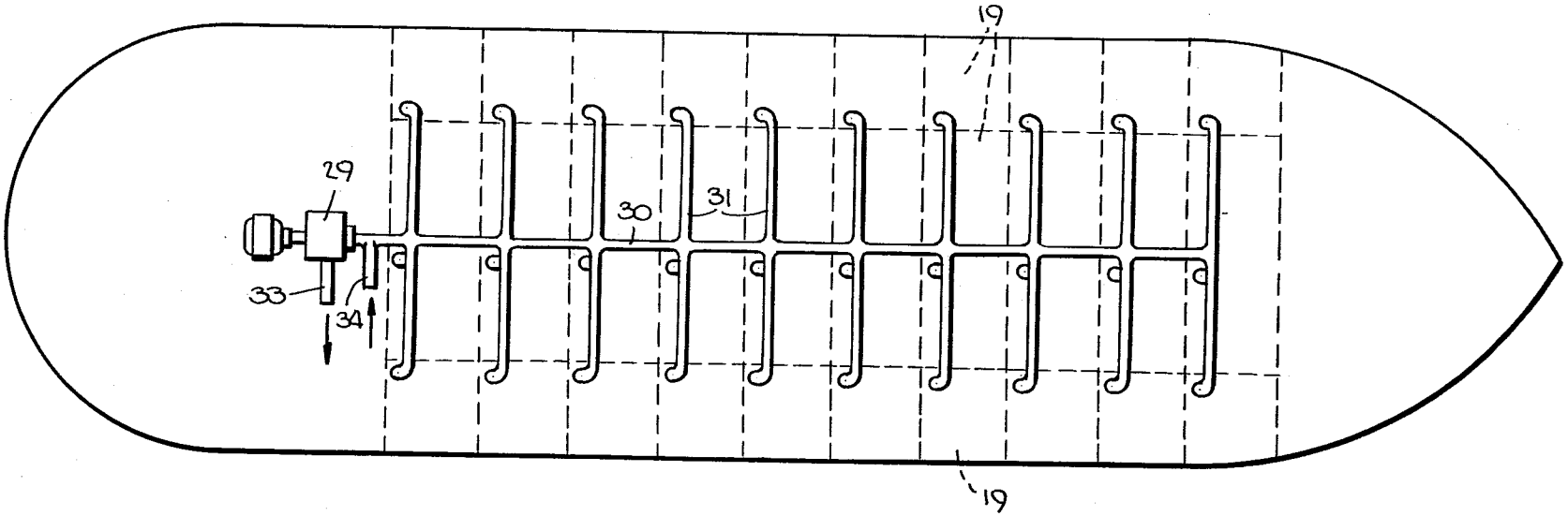
FIG. 4 is a top plan view of another embodiment of an improved liquid cargo tank construction for a tanker vessel constructed according to the present invention showing the additional charging and discharging means for the upper cargo tanks of the vessel.
Figure 5:
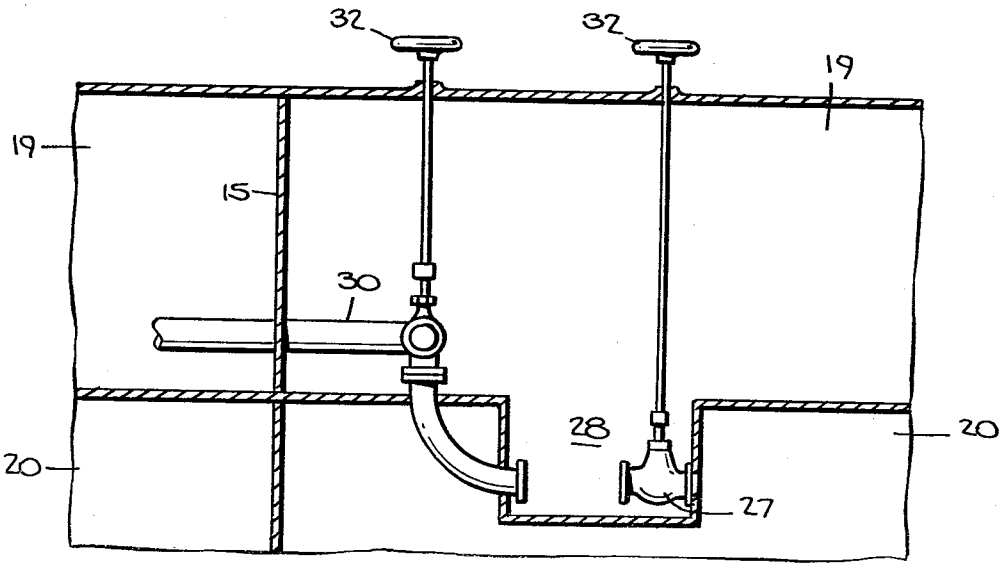
FIG. 5 is another partial, enlarged cross-sectional profile view of the liquid cargo tank construction illustrated in FIG. 4 showing the additional charging and discharging means within an upper cargo tank.

FIGS. 4 and 5 illustrate another embodiment of a liquid cargo tank constructed according to the invention. In this embodiment of the invention, valves 27 are disposed in sumps 28 provided in each of the upper cargo tanks 19 of the tanker vessel. The sumps collect liquid cargo in the upper cargo tanks and the valves, which are disposed between and couple each of the upper and lower cargo tanks in the vessel, permit transfer of the liquid cargo from upper tanks 19 to lower tanks 20 and vice-versa. The tanker vessel also includes an additional liquid cargo charging and discharging system for charging and discharging the upper cargo tanks which is redundant and is provided in addition to the main liquid cargo charging and discharging system (not shown) coupled to the upper and lower cargo tanks of the tanker vessel. The additional charging and discharging means includes suction means, which may comprise a motordriven pump 29, such as a centrifugal pump or a rotary pump which is suitable for use with the tanker vessel's emergency diesel generator output, coupled to a first pipe 30 extending longitudinally within the upper cargo tanks 19 and a plurality of transversely-disposed second pipes 31 coupled to pipe 30 which interconnect the upper cargo tanks. A discharge outlet 33 is coupled to the pump and a charging inlet 34 is coupled to pipe 30 for loading and unloading the upper cargo tanks. The additional charging and discharging means may, as previously mentioned, be used for cargo salvage, for charging and discharging multigrade cargoes, and for the transfer of liquid cargo from one of the upper cargo tanks to another of the tanks, either upper or lower, in the vessel. Both the valves 27 and the second pipes 31 of the additional liquid cargo charging and discharging system are controlled by hand wheels 32 which extend vertically upwardly above the top deck 13 of the vessel. The valves and the hand wheels are located at the aft end of the upper cargo tank.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a vessel disposed in water carrying a liquid having a specific gravity which is less than that of water, said vessel including a bottom, sides and a top forming at least one watertight compartment between said top and said bottom for carrying said liquid, the improvement comprising a watertight horizontal bulkhead disposed within said vessel between said top and said bottom at a distance above the waterline of said vessel which is approximately equal to $H(S_w/S_c-1)$, where H represents the vertical height of the waterline of the vessel above said bottom, $S_w$ represents the specific gravity of water, and $S_c$ represents the specific gravity of said liquid, said horizontal bulkhead forming separate upper and lower watertight tanks within said compartment above and below said waterline of said vessel, said upper one of said tanks having a vertical height which is less than that of said lower one of said tanks.

2. The improvement recited in claim 1, wherein said horizontal bulkhead is disposed within said vessel at a distance above the waterline of said vessel of about $H(S_w/S_c-1)-1$, where H represents the vertical height in feet of the waterline of said vessel above said bottom, $S_w$ represents the specific gravity of water, $S_c$ represents the specific gravity of said liquid, and $H(S_w/S_c-1)$ having a value greater than 1.

3. In a tank vessel carrying liquid cargo having a specific gravity which is less than that of water, said vessel including a hull comprising a bottom and sides, a top deck, and at least one transverse bulkhead disposed within said hull forming a plurality of watertight cargo compartments between said top deck and said hull bottom, the improvement comprising a watertight horizontal bulkhead disposed within said hull between said top deck and said hull bottom at a distance above the waterline of said vessel which is approximately equal to $H(S_w/S_c-1)$, where H represents the vertical height of the waterline of the vessel above said hull bottom, $S_w$ represents the specific gravity of water, and $S_c$ represents the specific gravity of said liquid cargo, said horizontal bulkhead forming separate upper and lower watertight cargo tanks within at least one of said cargo compartments above and below said waterline of said vessel, said upper tanks having a vertical height which is less than that of said lower tanks.

4. The improvement recited in claim 3, wherein said horizontal bulkhead is disposed within said vessel at a distance above the waterline of said vessel of about $H(S_w/S_c-1)-1$, where H represents the vertical height in feet of the waterline of said vessel above said hull bottom, $S_w$ represents the specific gravity of water, $S_c$ represents the specific gravity of said liquid cargo, and $H(S_w/S_c-1)$ having a value greater than 1.

5. The improvement recited in claim 3, further comprising valve means disposed between and coupling said upper and lower cargo tanks for permitting transfer of said liquid cargo from said upper tank to said lower tank and from said lower tank to said upper tank.

6. The improvement recited in claim 5, wherein said tanker vessel includes a plurality of longitudinal and transverse bulkheads disposed within said hull, wherein said horizontal bulkhead forms separate upper and lower watertight cargo tanks in a plurality of said cargo compartments, and wherein said vessel includes main liquid cargo charging and discharging means coupled to said upper and lower cargo tanks for charging and discharging said upper and lower cargo tanks and additional liquid cargo charging and discharging means coupled to said upper cargo tanks for charging and discharging said upper cargo tanks.

7. The improvement recited in claim 6, wherein each of said upper cargo tanks further comprises sump means for collecting liquid cargo in said upper cargo tanks, said valve means in each of said upper cargo tanks being disposed in said sump means.

8. The improvement recited in claim 6, wherein said additional charging and discharging means includes suction means for removing said liquid cargo from said upper cargo tanks.

9. The improvement recited in claim 8, wherein said suction means comprises motor-driven pump means.

10. The improvement recited in claim 8, wherein said additional charging and discharging means comprises first pipe means coupled to said suction means, and second pipe means coupled to said first pipe means and said upper cargo tanks, said first and second pipe means interconnecting said upper cargo tanks.

* * * * *